US009182181B2

(12) United States Patent
Adams et al.

(10) Patent No.: US 9,182,181 B2
(45) Date of Patent: Nov. 10, 2015

(54) CONDENSATE DRAIN TRAP FOR AN AIR CONDITIONING SYSTEM

(71) Applicants: William C. Adams, Murrysville, PA (US); Jeffrey A. Adams, New Alexandria, PA (US)

(72) Inventors: William C. Adams, Murrysville, PA (US); Jeffrey A. Adams, New Alexandria, PA (US)

( * ) Notice: Subject to any disclaimer, the term of this patent is extended or adjusted under 35 U.S.C. 154(b) by 0 days.

(21) Appl. No.: 13/836,650

(22) Filed: Mar. 15, 2013

(65) Prior Publication Data

US 2014/0238506 A1 Aug. 28, 2014

Related U.S. Application Data

(60) Provisional application No. 61/770,861, filed on Feb. 28, 2013.

(51) Int. Cl.
*F28F 17/00* (2006.01)

(52) U.S. Cl.
CPC ..... *F28F 17/005* (2013.01); *Y10T 137/5762* (2015.04)

(58) Field of Classification Search
CPC ... F24F 13/22; F24F 2013/227; F24F 13/222; F16K 15/147; F16K 27/065; F16K 27/0236; F16K 31/165; F16T 1/14; F16L 55/07; F28F 17/005; F28B 9/08; F28B 9/10; F28B 11/00; Y10T 137/5762; Y10T 137/3021; Y10T 137/3052; Y10T 137/3056; Y10T 13/88054; Y10T 13/7882
USPC ..... 137/177, 187, 188, 614.2, 849; 62/285–291
See application file for complete search history.

(56) References Cited

U.S. PATENT DOCUMENTS

| | | | | | |
|---|---|---|---|---|---|
| 1,861,875 | A | * | 6/1932 | Percival | 62/286 |
| 2,089,088 | A | * | 8/1937 | Fowler | 62/283 |
| 2,106,325 | A | * | 1/1938 | Kummer | 62/312 |
| 2,122,482 | A | * | 7/1938 | Marr et al. | 62/288 |
| 2,347,988 | A | * | 5/1944 | Burke | 137/849 |
| 2,438,594 | A | * | 3/1948 | Zapart et al. | 62/285 |

(Continued)

OTHER PUBLICATIONS

Joey Novak, "Joey's Blog Thoughts on Life, Work, Technonlogy, and Society", "Why A/C Units Need a proper P-Trap, and how to build one", date Aug. 20, 2011, [retrieved on Jun. 22, 2015]. Retrieved from the Internet< URL:http://joeynovak.com/blog/uncategorized/why-ac-units-need-a-proper-p-trap-and-how-to-build-one/>.*

(Continued)

*Primary Examiner* — John K Fristoe, Jr.
*Assistant Examiner* — Craig J Price
(74) *Attorney, Agent, or Firm* — Nils H. Ljungman & Associates

(57) ABSTRACT

A condensation drain trap for a drain outlet of an air conditioner for draining of condensate waste water. The drain trap has a diaphragm divided by cuts into a plurality of sections to permit the diaphragm to deform, upon the air conditioner being first turned on and a negative pressure being generated inside the air conditioner, to allow passage of air, in a controlled fashion, through the drain trap and into the air conditioner. The diaphragm is designed to retain a column of waste water in the drain trap to balance the negative pressure inside the air conditioner, while the cuts are such that when the column of waste water exceeds a predetermined height or volume, the excess waste water drains out through the diaphragm to maintain the column of waste water at the predetermined height or volume.

10 Claims, 9 Drawing Sheets

(56) References Cited

U.S. PATENT DOCUMENTS

| | | | | | |
|---|---|---|---|---|---|
| 2,524,764 | A | * | 10/1950 | Burke | 137/512.4 |
| 2,629,393 | A | * | 2/1953 | Langdon | 137/849 |
| 2,688,979 | A | * | 9/1954 | Kendrick | 137/849 |
| 3,707,986 | A | * | 1/1973 | Breen | 137/849 |
| 4,592,100 | A | * | 6/1986 | Robertson et al. | 137/614.2 |
| 4,877,160 | A | * | 10/1989 | Derving | 137/512.3 |
| 5,105,997 | A | * | 4/1992 | Wakabayashi et al. | 222/494 |
| 5,218,838 | A | * | 6/1993 | Kitamoto et al. | 62/288 |
| 6,487,867 | B1 | * | 12/2002 | Herren | 62/285 |
| 7,766,044 | B2 | * | 8/2010 | Makowan et al. | 137/849 |
| 2014/0130888 | A1 | * | 5/2014 | Kaiser et al. | 137/15.01 |

OTHER PUBLICATIONS

Andrew Leahy, "Why Do You Need a Trap on an Air Conditioner Drain", no date, eHow, [ Retrieved on Jun. 22, 2015] Retrieved from the internet :<URL: http://ehow.com/info_10005208_need-trap-air-conditioner-drain.html>.*

"Central Air Units Condensate Drain Pan N Line", no author, no date, [Retrieved on Jun. 22, 2015] Retrieved from the Internet:<URL: www.central-air conditioner-and refrigeration.com/central_air_units.html>.*

* cited by examiner

CONDENSATE DRAIN TRAP FOR AN AIR CONDITIONING SYSTEM

BACKGROUND

1. Technical Field

The present application relates to a condensate drain trap for an air conditioning system.

2. Background Information

In the operation of a typical air conditioning or refrigeration system, moisture from the air is condensed on an evaporator coil and accumulates in a drain pan situated below the coil. A typical drain pan has a tube or threaded connection for connecting an external pipe to carry the water to a safe location for disposal. Air is drawn over the evaporator coil by a blower which causes a negative pressure in the blower compartment, where the drain pan is located. Air conditioning manufacturers specify installing a U-shaped drain trap in the drain line to balance atmospheric pressure with the negative pressure in the drain pan. Condensate water will not drain from the drain pan unless this U-shaped drain trap is installed in the drain line. However, this system has inherent problems. The U-shaped drain trap must be or should be primed before water can flow out of the drain pan. If the U-shaped drain trap is not primed, the velocity of the air blows condensate into the interior of the blower compartment causing corrosion and algae to form. Other problems with the U-shaped drain trap is it, by nature of its design, traps dirt and algae, eventually blocking the flow of condensate. In the winter season, water in the U-tube freezes and cracks, damaging the trap.

OBJECT OR OBJECTS

An object of the present application is to essentially eliminate or reduce the need or desire for a U-shaped condensate trap to balance the negative pressure in the blower compartment of an air conditioning system.

SUMMARY

The present application discloses using a segmented elastomeric valve in the air conditioner condensate drain that allows the passage of air, in a controlled fashion, in one direction and allows liquid to pass in the opposite direction when the drain trap pressure equalizes. Initially, when an air conditioner starts running, the condensate drain is empty and air is drawn into the drain through the segmented disc which deforms enough to allow the passage of air. When enough condensate forms on the evaporator coil it collects in the drain pan and flows into the condensate drain and rises to a height which balances the negative pressure in the air conditioner. When this occurs, air ceases to flow into the condensate drain valve and a liquid column of water is sustained as the valve deforms to allow excess water to drain off. This action continues until the air conditioner shuts off, at which time the column of water collapses because the negative pressure no longer exists in the air conditioner. When the water column collapses it exits the drain carrying dirt, algae and bacteria that accumulated. During the off period the condensate drain dries out preventing algae and bacteria from forming since no water is present. The present application reduces the chance of debris plugging the drain and reduces breakage due to winter freezing because it releases the trapped water when the condensate stops flowing from the air conditioner. Any residual condensate is eliminated through evaporation. This prevents and/or minimizes debris, algae and bacteria accumulation and winter freezing. Other types of pressure condensate drains essentially eliminate or reduce debris accumulation and winter freezing but, require and/or desire air conditioning apparatus modification at high installation cost.

Another feature of the present application is the incorporation of a built-in shut off valve. The shut-off valve facilitates cleaning the drain line downstream of the condensate drain and the condensate drain itself should that become necessary and/or desired. The shut-off valve isolates the condensate drain from the condensate drain pan when in the closed position. Removing the cap from the valve allows cleaning the condensate drain and drain line by applying a slight pressure or vacuum to the hollow valve plug.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

DESCRIPTION OF EMBODIMENT OR EMBODIMENTS

With reference to the drawings, the present application will be described in detail with regard to one possible embodiment. In general, the present application is a combination fluid trap and shut-off valve for use with liquid drainage systems and in one possible embodiment, for use with condensate moisture drainage systems used with air conditioner or air handler units, coolers or ice makers, where it is desirable or necessary to drain fluid from the unit while preventing or minimizing backflow of fluid into the drain system.

Figure 1:
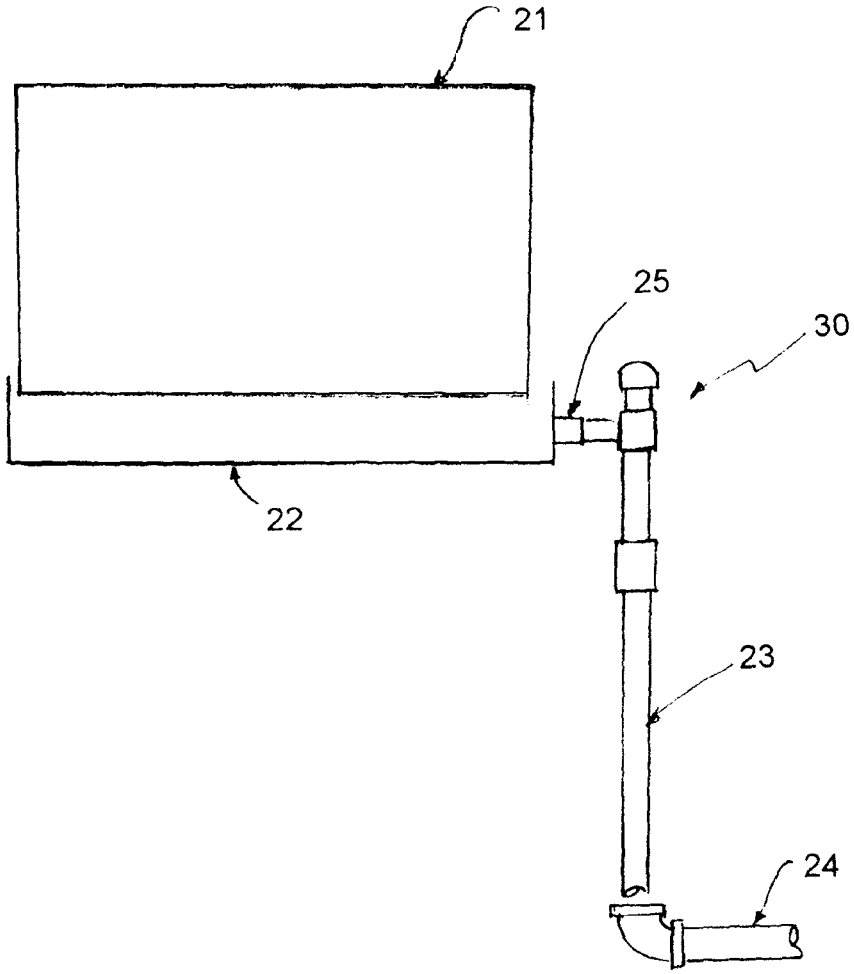
FIG. 1 shows a condensate drain trap assembly according to at least one possible embodiment of the present application.

Referring to FIG. 1, the present application is a condensate drain trap assembly 30 which is connected to a condensate drain pan 22 which collects condensate from an evaporator coil 21. The condensate drain trap can drain freely as shown or it can be connected to drain line 23, which drains into a trapped sanitary drain 24.

Figure 2:
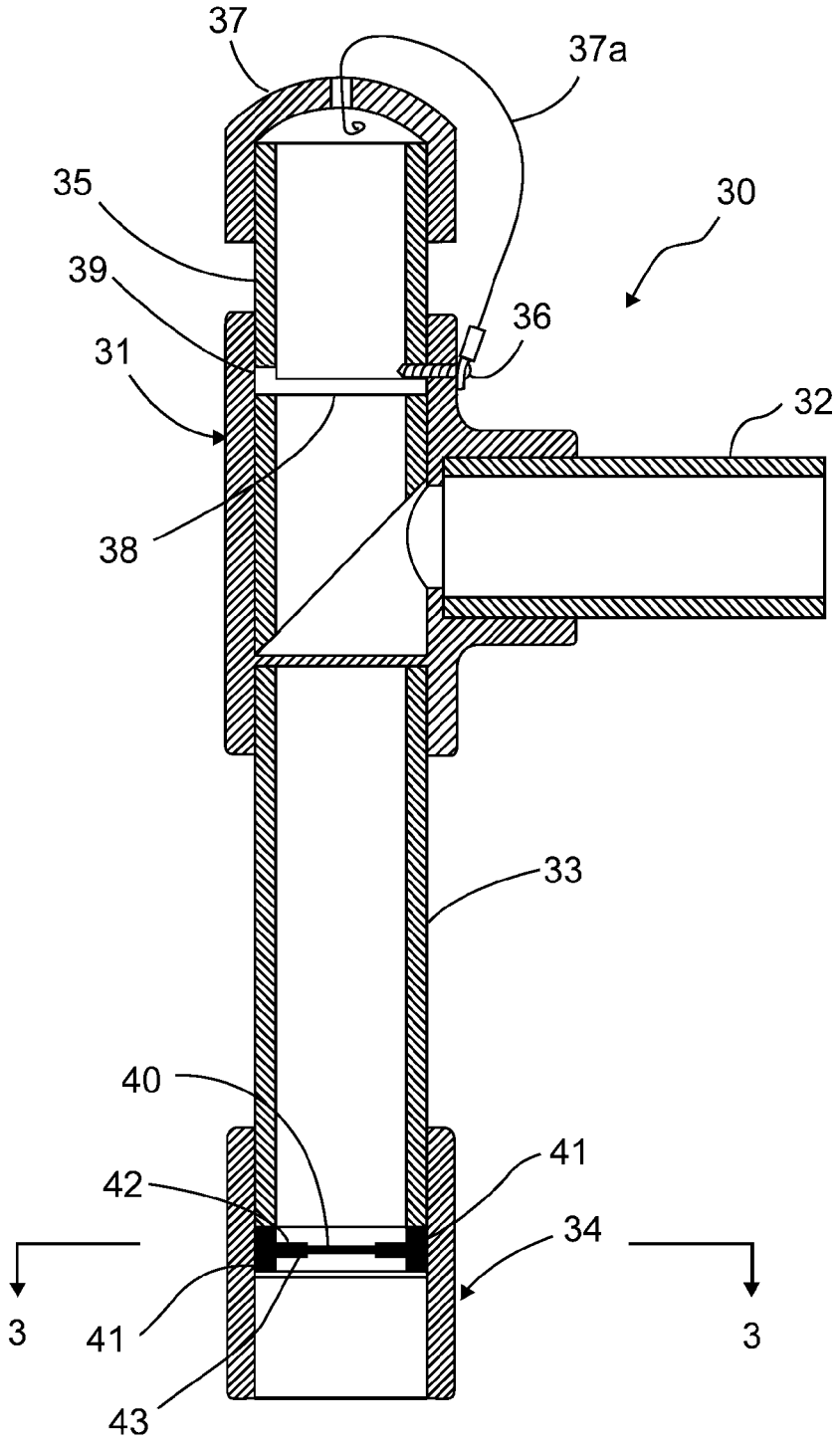
FIG. 2 shows a condensate drain trap comprising two valve bodies, a shut-off valve body, and a drain valve body.

FIG. 2 shows the condensate drain trap in greater detail. The pipe 32 which conducts water from the drain pan 22 is connected to a tee joint 31 which permits the condensate to flow into the vertical pipe 33 and then down to a diaphragm valve 40 which is shown in greater detail in FIG. 3.

Figure 3:
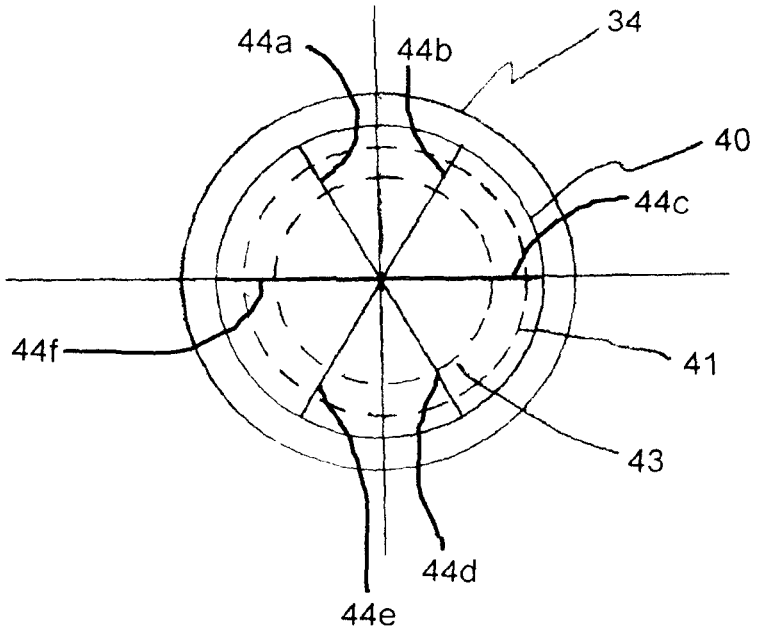
FIG. 3 shows one possible embodiment of a diaphragm valve according to the present application.

FIG. 3 shows one embodiment of the diaphragm valve 40 which comprises a diaphragm which is horizontally disposed in FIG. 2. The diaphragm valve 40 has a series of cuts 44*a*-44*f* across it. When a predetermined amount of water is disposed above the diaphragm valve 40 the cuts open and allow the water above the diaphragm valve 40 open and discharge the water into the drain pipe 23. By choosing the material which the diaphragm valve 40 is made of and thereby determining the rigidity of the material and further thickness of the material that the diaphragm valve 40 is made of, the pressure at which the diaphragm valve 40 will open is determined. Any one of a series of plastics could be used to make the diaphragm valve 40 to provide the appropriate back pressure to maintain the water column above the diaphragm valve 40 at a desired value to assure that the height of the water column above the diaphragm valve 40 is at an appropriate height for the operating conditions of the air conditioner 21. By making the diaphragm of the diaphragm valve 40 thinner, the pressure of the water above the diaphragm valve 40 will be held at a lower value which will result in a shorter water column above the diaphragm valve 40. Conversely, by making the diaphragm of the diaphragm valve 40 thicker, the pressure of the water above the diaphragm valve 40 will be held at a higher value which will result in a taller order, above diaphragm valve 40. In one possible embodiment of the present application, for negative 15.24 centimeters (six inches) of pressure, the thickness of the diaphragm valve 40 may be 0.030. In another possible embodiment of the present application, for negative 5.08 centimeters (two inches) of pressure, the thickness of the diaphragm valve 40 may be 0.015. Also, by providing a greater or smaller number of cuts 44*a*-44*f*, the pressure above the diaphragm valve 40 can be adjusted. A greater number of cuts will reduce the pressure of the water column of the diaphragm valve 40 such that water will leak out of the diaphragm valve 40 at a lower height of water column than if the number of cuts is less. The number of cuts 44*a*-44*f* in the diaphragm of the diaphragm valve 40 may vary from as low as two cuts from the middle of the diaphragm to as many as six cuts, as shown in FIG. 3, in one cut increments. Additional cuts such as seven, eight, nine, or greater may be useful in certain applications. In addition, the diameter of the diaphragm valve 40 may vary in order to increase or decrease the pressure above the diaphragm valve 40. In one possible embodiment of the present application, the diaphragm valve 40 may have a diameter of 2.54 centimeters (one inch). In another possible embodiment, the diaphragm valve 40 may have a diameter of 1.905 centimeters (0.75 inch). In yet another possible embodiment, the diaphragm valve 40 may have a diameter of 3.175 centimeters (1.25 inches).

By choosing the material of which the diaphragm valve 40 is made, the thickness of this material and the number of cuts 40*a*-40*f* the pressure at which the diaphragm valve 40 will open and release water from water column above the diaphragm valve 40 can be varied. In one possible embodiment of the present application, the diaphragm valve 40 or membrane 40 or membrane valve 40 may comprise urethane, manufactured by Applied Urethane Technology, Inc., 6507 Hane Avenue, Baltimore, Md. 21237.

Depending upon the pressure or rather the negative pressure in the air conditioner 21, the desired pressure of the water column above the diaphragm valve 40 can also be varied in order to provide an appropriate water column above the diaphragm valve 40. Therefore, the parameters of the diaphragm can be adjusted appropriately for each different air conditioner 21. Often, it is desirable, for a specific height of the water column above the diaphragm valve 40, to be maintained at a particular height for the operation of a particular air-conditioner 21.

Figure 4:
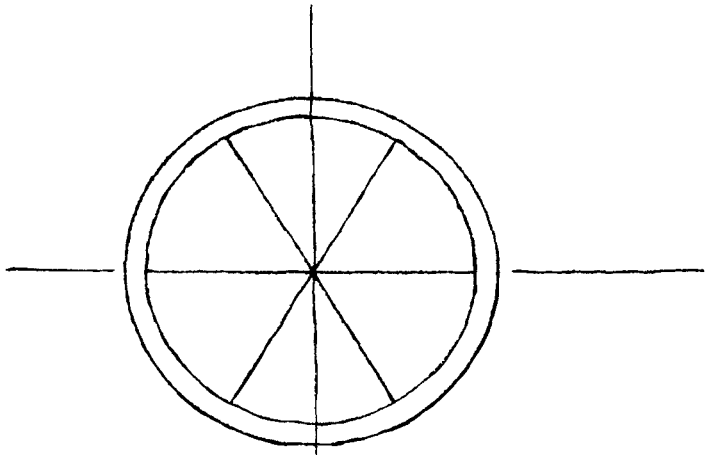
FIG. 4 shows another possible embodiment of a diaphragm valve according to the present application.
Figure 5:
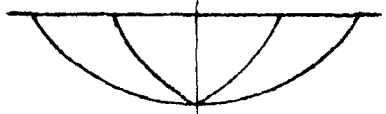
FIG. 5 shows yet another possible embodiment of a diaphragm valve according to the present application.

The diaphragm valve 40 as shown in FIGS. 3 and 4 may be flat, or as shown in FIG. 5, the diaphragm valve 40 may be convex downward to assist in the opening of the diaphragm valve 40 at lower pressures, that is, if all the other parameters of the diaphragm valve 40 are essentially the same.

Referring again to FIG. 2, within the T fitting 31 there is disposed a valve 35, also called a valve plug 35 herein, which can be turned to close off the opening between the pipe 32 and the T fitting 31 when water is being flushed through the valve 35 and the pipe 33 in order to clean the condensate drain trap 30 and the diaphragm valve 40. A cap 37 is provided on top of the valve 35 such that the upper portion of the valve 35 can be sealed at least partially from the outer atmosphere when water is not being used to flush the condensate drain trap and its diaphragm valve 40. A cable 37*a* is connected to the top of the cap 37 and also to the tee fitting 31 by a screw 36, so that the cap 37 does not become lost upon removal from the valve 35. The screw 36 can also be used to prevent or minimize removal of the valve 35 and permit a slot in valve 35 to permit valve 35 to rotate from an open position to a closed position, opening and closing access to pipe 32.

Referring again to FIG. 2, the diaphragm valve 40 has additional portions 42 and 43 which strengthen the portions between the cuts 44*a*-44*f* so that the portions between the cuts which are closest to the center of the diaphragm of the diaphragm valve 40 are thinner than the additional portions 42 and 43. Since the ends of the diaphragm of the diaphragm valve 40 closer to the center thereof are thinner, they will begin to deflect first and allow water from the condensate to past through the diaphragm valve 40 upon the water column above the diaphragm 40 reaching a particular height. When the air conditioning unit 21 turns off, the negative pressure within the unit will become zero with respect to the ambient pressure about the air-conditioning unit 21, and the water column above the diaphragm valve 40 will leak through the diaphragm valve to a value which may be from about zero to a fraction of 2.54 centimeters (one inch) or more.

As shown in FIG. 2, condensate drain trap 30 is comprised of two valve bodies, a shut-off valve body 31 and a drain valve body 34. The T-shaped shut-off valve body 31, which is hollow, has an upstream member 32 and a downstream member 33. The downstream member is connected to a drain valve body 34. In at least one possible embodiment of the present application, the shut-off valve body 31 and drain valve body 34 may be constructed from polyvinyl chloride ("PVC") the same material from which drain line 23 is typically constructed. Other materials of construction can be used such as other plastics, brass or other cast, machined or extruded materials.

Upstream member 32 is used to connect shut-off valve body to drain pan fitting 25 (FIG. 1). Downstream member 33 is used to connect shut-off valve body 31 to drain valve body 34. Inlet member 32 and the drain valve body 34 re-sized to be equivalent to standard PVC plumbing fittings for easy connection.

The shut-off valve portion of the condensate drain trap has a valve plug 35 which is placed inside the hollow shut-off valve body 31. Valve plug 35 is cylindrical in shape and is also hollow. Valve plug 35 is square on one end and is angled on the other end. The outside diameter of valve plug 35 is slightly smaller than the inside diameter of shut-off valve body such that valve plug 35 proximally engages the inside walls of shut off valve body 31 yet can be rotated easily. This allows condensate to flow freely when the valve plug 35 is positioned in one direction and block the flow of condensate when positioned in the opposed direction. A slot 38 extends half way through the valve plug 35 and perpendicular or substantially perpendicular to the longitudinal axis of the valve plug 35 with two smaller slots 39 parallel or substantially parallel to the longitudinal axis of valve plug 35 but 180 degree opposed to each other. A pin 36 fastened to shut-off valve body 31 extends into the slot 39 in valve plug 35 which holds it in either the "open" or "closed" position. A cap 37 is placed on the square end of the valve plug 35 using a slight press fit. A tether 37*a* is attached to valve body 31 using pin 36 and secured to cap 37 to keep the cap from becoming lost. The cap can be removed and either pressure or vacuum applied to the valve plug 35 to remove any blockage from the condensate drain trap 30 or drain line 23.

The drain valve body 34 of the condensate drain trap has a flexible segmented elastomeric disc 40 held in place by two annular rings 41. The condensate drain trap can be configured to balance a variety of negative pressures. This is achieved by sizing the elastomeric disc 40, orifice 42, orifice 43 and the length of the outflow member 33. The pressure drop through the drain valve 34 is governed by the diameter, thickness, hardness, material composition and number of segments of the disc 40, the diameter of orifice 42, and the diameter of orifice 43. The pressure drop through the drain valve 34 and the length of the outflow member 33 will determine the negative pressure rating of the condensate drain 30.

Figure 6A:
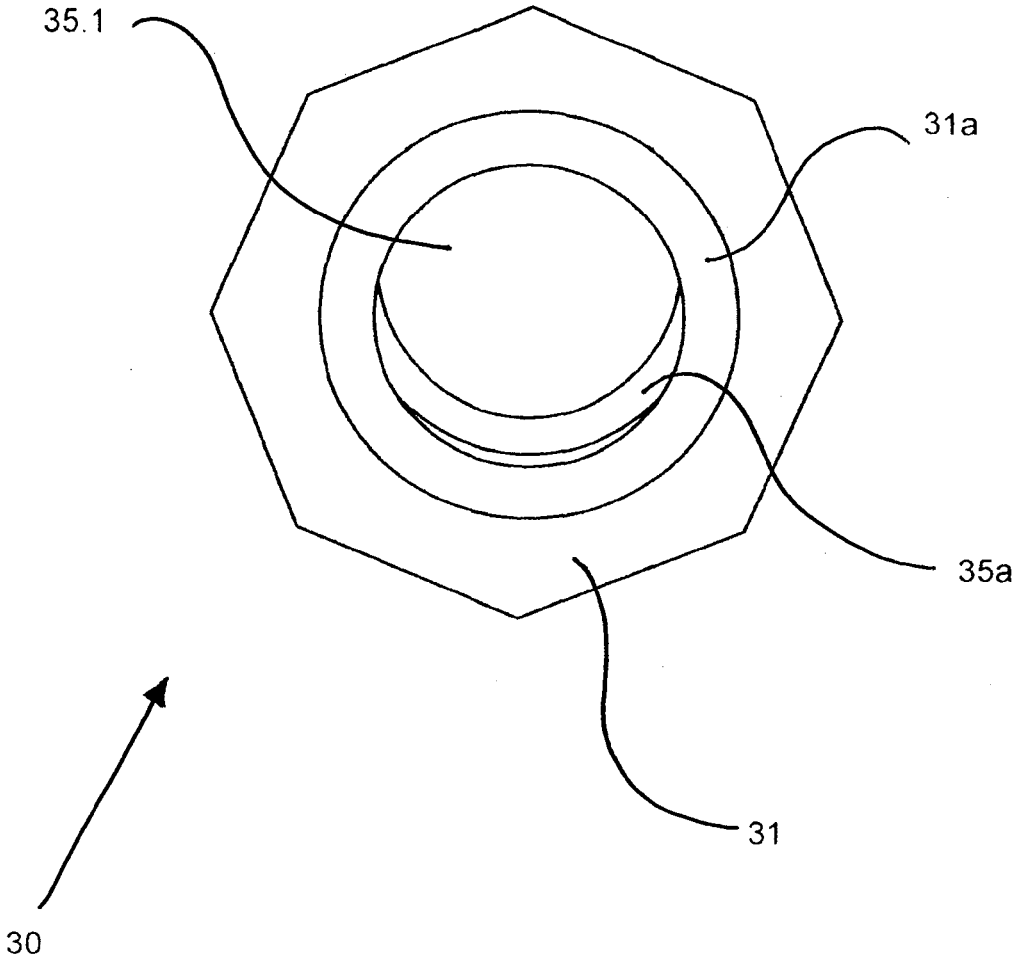
FIGS. 6A through 6E show the valve as the valve is moved from an open position to a closed position.

FIG. 6A shows the valve 35 of the drain trap 30 in the open position. The angled rim 35*a* of the valve plug 35 is facing the opening of the T-fitting connected to the upstream member 32, shown through the mouth 31*a* of the T-fitting connected to the upstream member 32. The interior 35.1 of the valve plug 35 is visible through the rim 35*a* and mouth 31 a of the T-fitting 31. In the open position, water is permitted to flow from a drain pan of an air conditioning unit, through an upstream member and through a valve 35 of the T-fitting 31, and then through a downstream member.

Figure 6B:
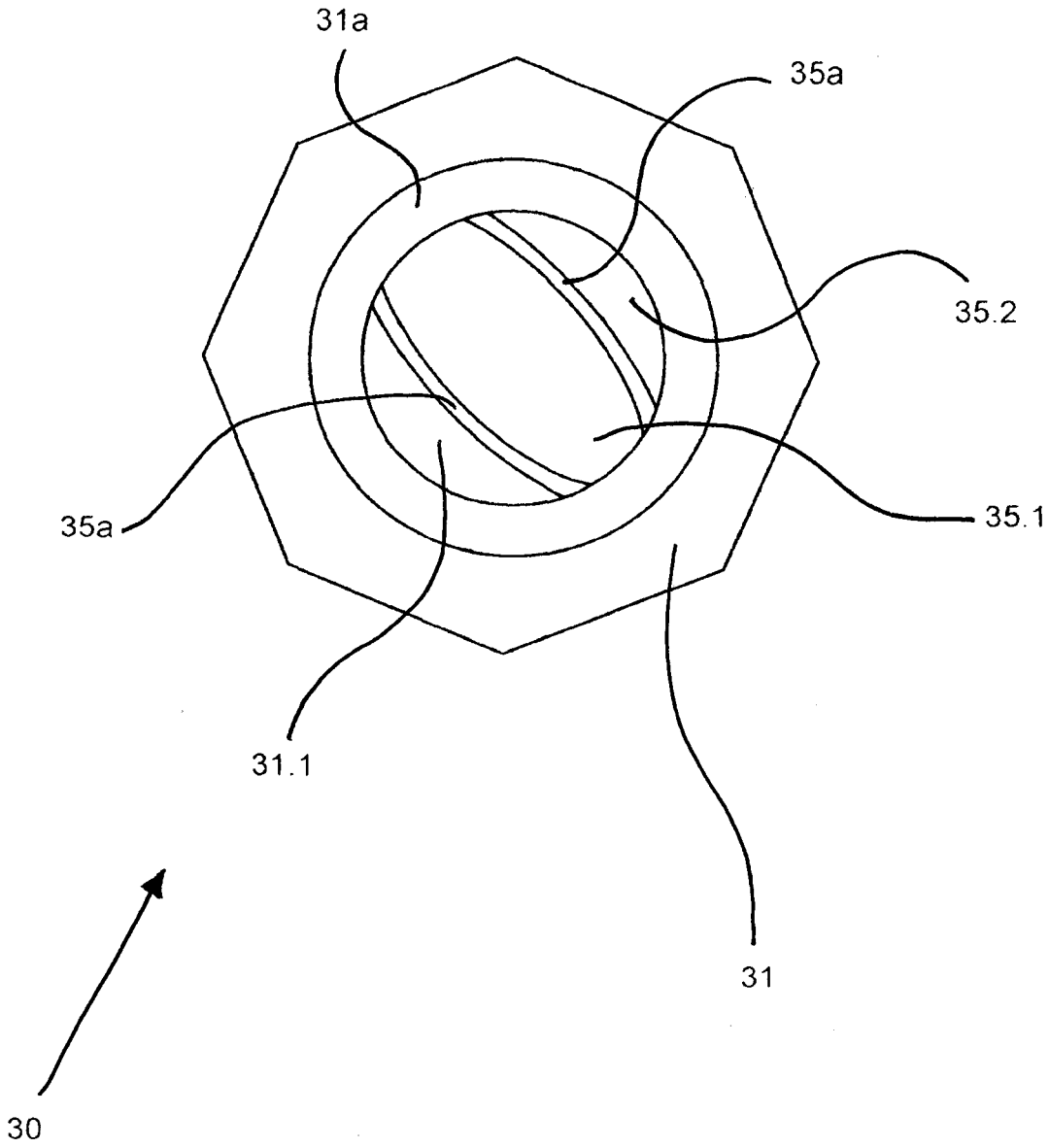

FIG. 6B shows the valve 35 of the drain trap 30 as the valve 35 is beginning to be closed. The valve 35 has been turned or rotated an angle of approximately forty-five degrees. Both the interior 35.1 and the exterior 35.2 of the valve plug are partially visible through the mouth 31*a* of the T-fitting 31. The interior 31.1 of the T-fitting 31 is also partially visible through the mouth 31 a of the T-fitting 31. In this position, water may still be able to flow through the valve 35, from the upstream member to the downstream member.

Figure 6C:
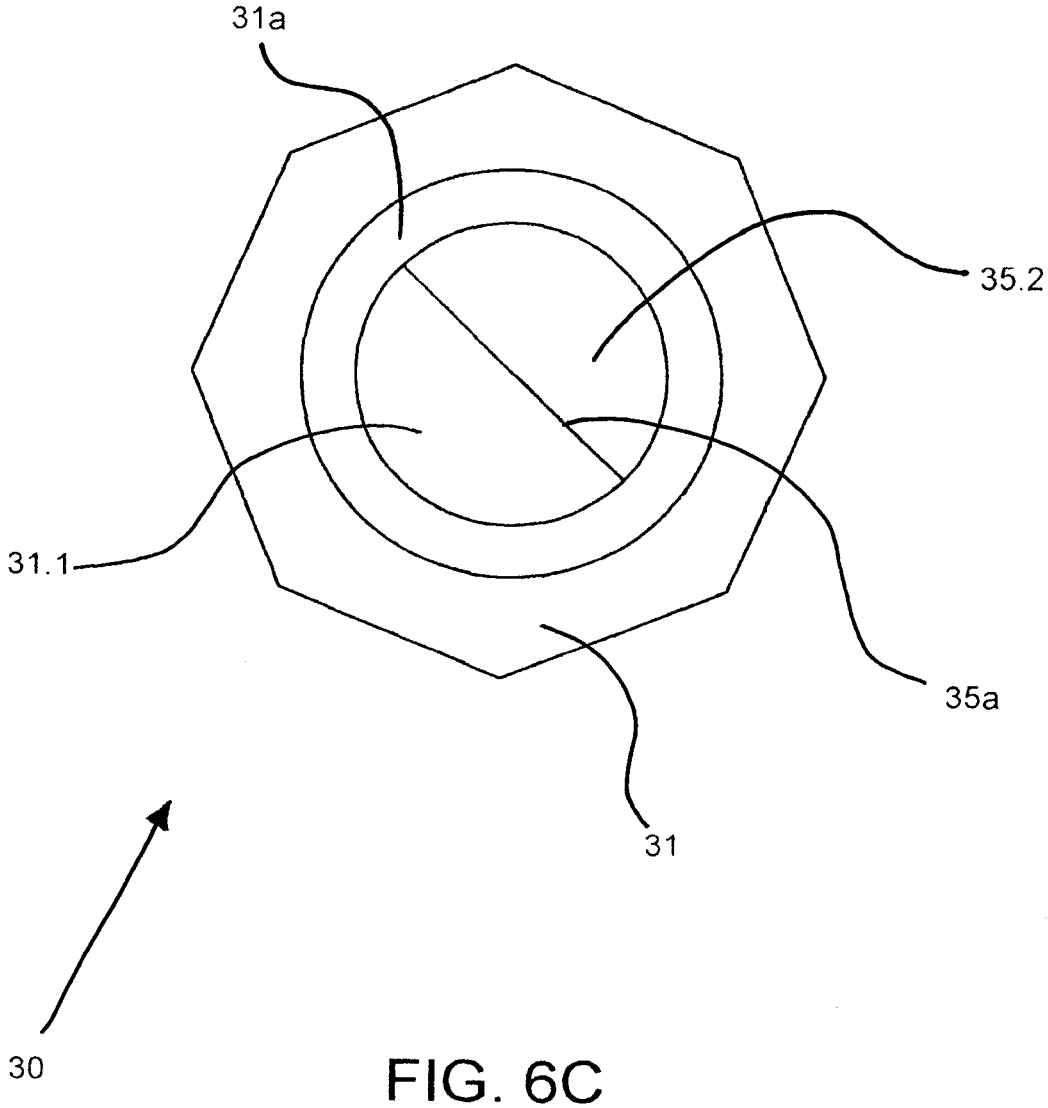

FIG. 6C shows the valve of the drain trap 30 as the valve is halfway between the open position and closed position. The valve 35 has been turned or rotated an angle of approximately ninety degrees from the open position. The exterior 35.2 of the valve 35 and the interior 31.1 of the T-fitting 31 are visible through the mouth 31 a of the T-fitting 31.

Figure 6D:
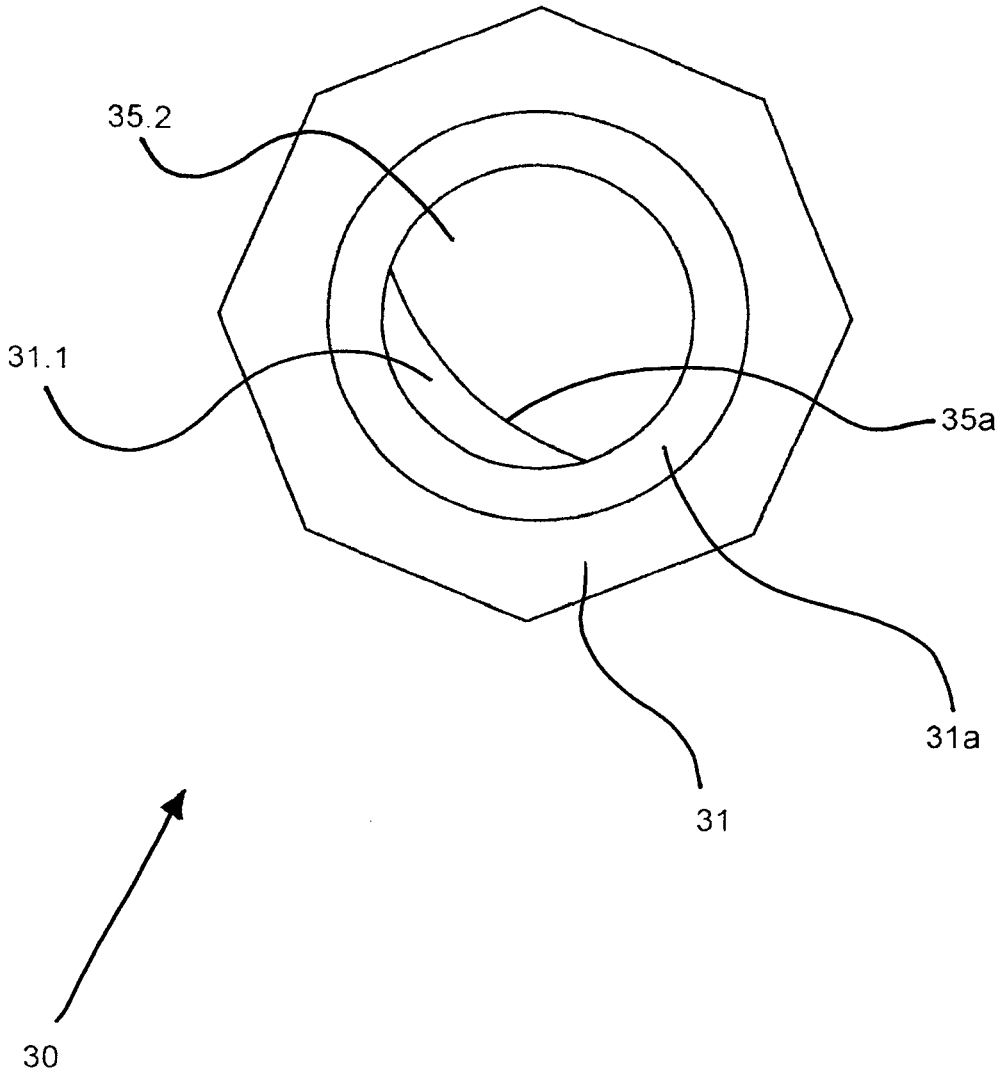

FIG. 6D shows the valve in the drain trap 30 as the valve 35 is almost closed. The valve has been turned or rotated an angle of approximately one hundred thirty-five degrees from the open position. The exterior of the valve 35.2 and the interior 31.1 of the T-fitting 31 are visible through the mouth 31 a of the T-fitting 31.

Figure 6E:
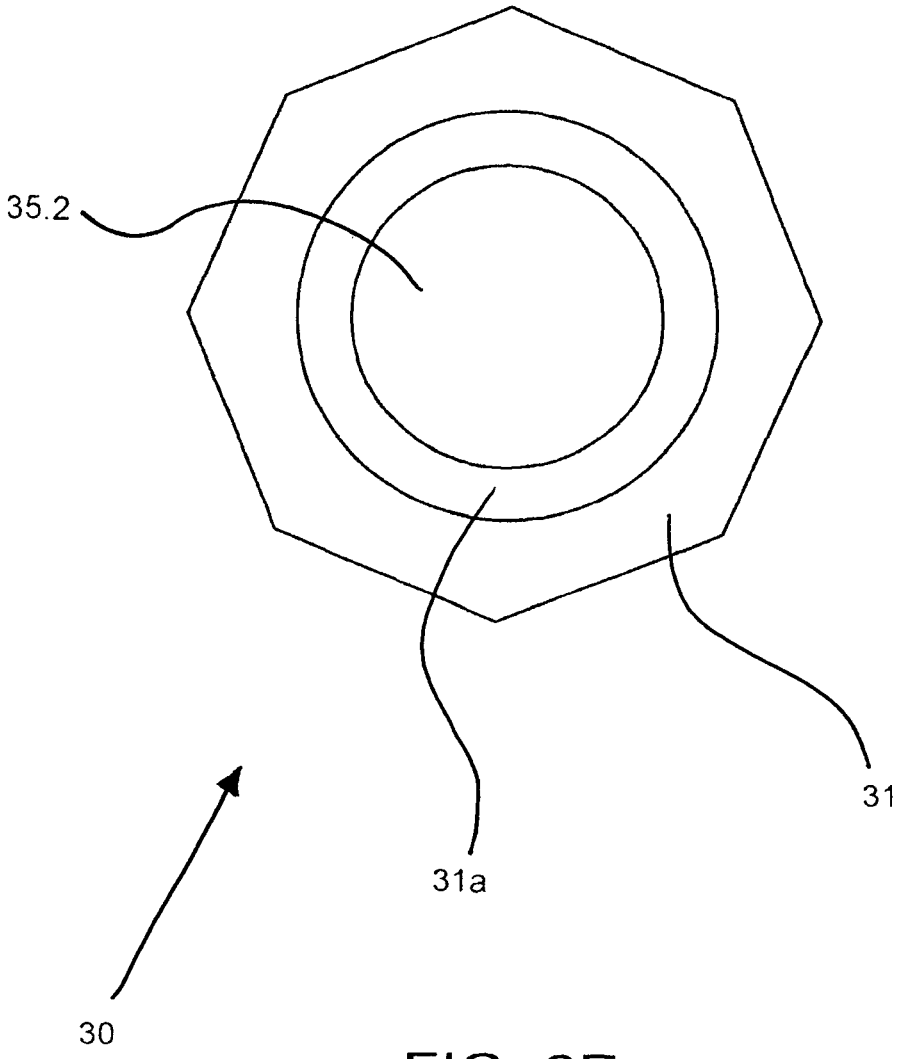

FIG. 6E shows the valve of the drain trap 30 in the closed position. The valve has been turned or rotated an angle of one hundred eighty degrees from the open position. The exterior 35.2 of the valve plug 35 is visible through the mouth 31 a of the T-fitting 31. Water may be prevented, restricted, or minimized from flowing through the valve 35, from the upstream member to the downstream member.

The present application can be used on many air conditioning systems, or any other device which produces condensate waste water. It attaches to the condensate drain pan fitting requiring no modifications to the air conditioning equipment. It is self priming, self cleaning and will not freeze and break in the winter because it does not trap any substantial water when the air conditioner is not operating.

A combination shutoff valve and fluid trap device for connection to an outflow aperture of a condensate moisture drain system on an air conditioner or like apparatus, the device comprising an elastomeric segmented disc within a housing, having an inflow conduit for connection to the drain system whereby a metered amount of air can enter the outflow conduit until an adequate amount of condensate forms a water seal equal in height to the negative pressure in the system. The water column will be equal to the negative pressure in the system plus the pressure drop of the water flowing through the segmented disc. The water column will be sustained, allowing the condensate generated to exit the drain, until the pressure in the system changes. If the system pressure increases, becomes more negative, the water column will increase correspondingly, if the system pressure goes to zero when the air conditioning apparatus shuts down, the water column collapses, flushing debris from the drain. A built-in shut off valve in the drain trap provides a means of isolating the apparatus from the condensate drain pan to allow cleaning the outflow conduit attached to the condensate drain trap without having to remove the condensate drain trap.

The components disclosed in the patents, patent applications, patent publications, and other documents, if any, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications, patent publications, and other documents, if any, cited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, patent applications, patent publications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, patent applications, patent publications, and other documents either incorporated by reference or not incorporated by reference.

All of the references and documents cited in any of the patents, patent applications, patent publications, and other documents cited herein, except for the exceptions indicated herein, are hereby incorporated by reference as if set forth in their entirety herein except for the exceptions indicated herein. All of the patents, patent applications, patent publications, and other documents cited herein, referred to in the immediately preceding sentence, include all of the patents, patent applications, patent publications, and other documents cited anywhere in the present application.

Words relating to the opinions and judgments of the author of all patents, patent applications, patent publications, and other documents cited herein and not directly relating to the technical details of the description of the embodiments therein are not incorporated by reference.

The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments of the patents, patent applications, patent publications, and other documents, are not considered to be incorporated by reference herein for any of the patents, patent applications, patent publications, and other documents cited herein.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications, patent publications, and other documents cited herein may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A condensation drain trap in combination with an air conditioner, wherein:

- said air conditioner comprises a drain outlet to permit condensate waste water, comprising water or a mixture of water and contaminants, to drain from said air conditioner;
- said drain trap is connected to said drain outlet to receive the condensate waste water from said drain outlet;
- said drain trap comprises a vertical pipe portion and a valve disposed therein;
- said valve comprises a substantially flat diaphragm divided by cuts into a plurality of sections to permit said diaphragm to deform, upon said air conditioner being first turned on and a negative pressure being generated inside said air conditioner, to allow passage of air, in a controlled fashion, into said vertical pipe portion and then into said air conditioner; and said diaphragm is sufficiently rigid to retain a predetermined column of the condensate waste water in said vertical pipe portion of a volume sufficient to balance the negative pressure inside said air conditioner, and is sufficiently flexible and comprises a sufficient number of said cuts to also simultaneously permit an excess amount of the condensate waste water, in excess of the volume sufficient to balance the negative pressure inside said air conditioner, to drain out of said vertical pipe portion, to thereby maintain the predetermined column of the condensate waste water during operation of said air conditioner.

2. The condensation drain trap in combination with said air conditioner according to claim 1, wherein said diaphragm is sufficiently flexible and comprises a sufficient number of said cuts to drain essentially all of the condensate waste water retained thereby upon said air conditioner being shut off and the negative pressure being terminated.

3. The condensation drain trap in combination with said air conditioner according to claim 2, wherein said drain trap comprises a horizontal pipe portion disposed essentially perpendicular to said vertical pipe portion, which said vertical pipe portion connects said horizontal pipe portion to said drain outlet.

4. The condensation drain trap in combination with said air conditioner according to claim 3, wherein said horizontal pipe portion is connected to said vertical pipe portion adjacent a middle section of said vertical pipe portion, such that said vertical pipe portion extends above and below said horizontal pipe portion.

5. The condensation drain trap in combination with said air conditioner according to claim 4, wherein:

said vertical pipe portion comprising a bottom opening adjacent said diaphragm, and a top opening opposite said bottom opening; and said drain tap comprises a removable cap disposed on and to cover said top opening.

6. The condensation drain trap in combination with said air conditioner according to claim 5, wherein said drain trap comprises an additional valve disposed inside said vertical pipe portion at a connection between said vertical pipe portion and said horizontal pipe portion, which said additional valve is adjustable between an open and closed position to control flow of the condensate waste water from said horizontal pipe portion into said vertical pipe portion.

7. The condensation drain trap in combination with said air conditioner according to claim 1, wherein:

said vertical pipe portion comprising a bottom opening adjacent said diaphragm, and a top opening opposite said bottom opening; and said drain tap comprises a removable cap disposed on and to cover said top opening.

8. The condensation drain trap in combination with said air conditioner according to claim 1, wherein said drain trap comprises a horizontal pipe portion disposed essentially perpendicular to said vertical pipe portion, which said vertical pipe portion connects said horizontal pipe portion to said drain outlet.

9. The condensation drain trap in combination with said air conditioner according to claim 8, wherein said horizontal pipe portion is connected to said vertical pipe portion adjacent a middle section of said vertical pipe portion, such that said vertical pipe portion extends above and below said horizontal pipe portion.

10. The condensation drain trap in combination with said air conditioner according to claim 9, wherein said drain trap comprises an additional valve disposed inside said vertical pipe portion at a connection between said vertical pipe portion and said horizontal pipe portion, which said additional valve is adjustable between an open and closed position to control flow of the condensate waste water from said horizontal pipe portion into said vertical pipe portion.

* * * * *